United States Patent [19]

Yang

[11] 4,098,687

[45] Jul. 4, 1978

[54] BENEFICIATION OF LITHIUM ORES BY FROTH FLOTATION

[75] Inventor: David C. Yang, Houghton, Mich.

[73] Assignee: Board of Control of Michigan Technological University, Houghton, Mich.

[21] Appl. No.: 759,092

[22] Filed: Jan. 13, 1977

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,861,687 | 11/1958 | Lord | 209/167 |
| 2,974,884 | 3/1961 | Martin | 209/166 X |
| 2,990,958 | 7/1961 | Greene | 209/166 |
| 3,337,048 | 8/1967 | Mercade | 209/166 X |
| 3,589,622 | 6/1971 | Weston | 209/166 X |

OTHER PUBLICATIONS

Chem. Abst., 71, 1969, 63330u.

*Primary Examiner*—Robert Halper

[57] ABSTRACT

A high grade fraction is recovered from lithium-containing ores by conditioning a finely-ground aqueous pulp of the ore with a conditioning reagent formed by incorporating a water-soluble polyvalent metal salt into an aqueous solution of an alkali metal silicate and with an anionic collector and then subjecting the conditioned pulp, without desliming, to a froth flotation operation whereby a concentrate containing lithium and a tailing containing gangue are produced.

13 Claims, No Drawings

BENEFICIATION OF LITHIUM ORES BY FROTH FLOTATION

BACKGROUND OF THE INVENTION

This invention relates to the beneficiation of lithium-containing ores and, more particularly, to a process of beneficiating such ores by froth flotation to produce a high grade concentrate of lithium values.

The world's largest proven reserve of lithium ore is in the Kings Mountain district of North Carolina. This area includes substantial deposits of pegmatites containing an average of about 15 to 20% spodumene, which is basically $Li_2O.Al_2O_3.4SiO_2$. The spodumene is associated with other gangue minerals, such as felspar, quartz and muscovite, from which it must be separated to be useable in chemical and ceramic applications.

It is known to separate spodumene and other lithium values from gangue minerals with froth flotation processes in which an aqueous pulp of the ore is conditioned with an amine collector and the gangue is floated from the spodumene fraction. U.S. Pat. No. 3,710,934 (Wyman) discloses such a process. It is also known to separate spodumene with a froth flotation process in which an aqueous pulp of the spodumene-containing ore is conditioned with an anionic-type collector, such as fatty acids and their soaps, and the spodumene fraction is recovered in the froth product. U.S. Pat. No. 2,974,884 (Martin et al) discloses such a process. In either case, the ore pulps usually must be deslimed before an acceptable flotation of the gangue minerals or spodumene can be obtained. This desliming step adds to the processing costs and, more importantly, the slime fraction, which is usually disposed as waste, contains a substantial quantity of mineral values, particularly $Li_2O$.

SUMMARY OF THE INVENTION

The principal object of the invention is to provide a simple, efficient and economical process for beneficiating lithium-containing ores.

Another principal object of the invention is to provide a froth flotation process which is capable of separating a high grade lithium values fraction from pulps of lithium-containing ores and yet obtain a high recovery of $Li_2O$.

Other aspects, advantages and objects of the invention will become apparent to those skilled in the art upon reviewing the following detailed description and the appended claims.

According to the invention, the lithium values fraction of lithium-containing ores is floated from gangue slimes, preferably without the use of a desliming step, by a froth flotation process wherein an aqueous pulp of the ore is treated with a conditioning reagent which improves the selectivity of anionic collectors to spodumene and other lithium values. More specifically, the conditioning reagent is formed by incorporating a water-soluble polyvalent metal salt into an aqueous solution of a water-soluble alkali metal silicate. The conditioning reagent is added to and thoroughly mixed with the ore pulp before the pulp is subjected to conventional froth flotation in the presence of an anionic collector as the flotation agent.

U.S. Pat. No. 3,337,048 (Mercade) discloses a flotation process employing an anionic collector and a dispersant reagent containing sodium silicate and a polyvalent metal salt for floating colored titaniferous impurities from kaolin clay. However, it is well recognized that the flotation art is highly empirical and that a wide variety of factors may have a substantial or even a critical effect on the degree of separation attained. Therefore, determination of a combination of treatment reagents and/or operating conditions to obtain an effective separation of a particular material is largely unpredictable and can be obtained only by extensive testing and experimentation. The use of a conditioning reagent containing a water-soluble alkali metal silicate and a water-soluble polyvalent salt in combination with an anionic collector, in accordance with the invention, has been found to be surprisingly effective in the flotation of lithium values from gangue mineral in the presence of slimes.

While not completely understood at this time, and the invention is not limited to any specific theory, it appears that the conditioning reagent of the invention either modifies the surface characteristics of the gangue particles or is adsorbed on the surface of the gangue particles so as to prevent anionic collectors from bonding thereto and yet permits the gangue particles to become wetted so they will not float during froth flotation. It appears that the conditioning reagent also modifies the surface characteristics of the spodumene particles and other lithium values so they can more readily adsorbed anionic collectors and thereby become more readily attached to air bubbles during froth flotation.

The process of the invention, while eliminating the cost of a desliming step, has been found to be capable of obtaining a high recovery of a high grade spodumene fraction from pegmatite ores. That is, the process is capable of recoveries of $Li_2O$ higher than 80% with the recovered spodumene containing about 6 weight % $Li_2O$ or more.

DESCRIPTION OF THE PREFERRED EMBODIMENTS

While the process of the invention can be used for beneficiating various lithium ores, it will be described for beneficiating spodumene-containing ores. The spodumene-containing ore is ground to a fine size feed to permit liberation of spodumene from the gangue. Various conventional grinding techniques can be employed. For example, a crushed ore at a nominal size of about ½ inch is introduced into a rod mill along with a sufficient amount of water to produce a slurry containing, for example, about 55% solids.

The pulp discharged from the rod mill is transferred to a ball mill for further grinding to a predetermined fineness desired for the subsequent froth flotation. As is well known in the art, the particular particle size to which the ore is ground depends primarily on the specific ore being processed with finer particle size being required for ores having the gangue more tightly interlocked with the spodumene. Generally, the ore is ground to a nominal 48 mesh or to a point where at least about 60% passes a 200 mesh screen. All mesh sizes referred to herein are Tyler Series.

The ground pulp containing particles less than the predetermined maximum size, is transferred to one or more conditioners wherein the conditioning reagent, a pH adjustment reagent (optional) and an anionic collector is added to and thoroughly mixed with the pulp prior to froth flotation.

To obtain the best results with most ores, the pH of the ore pulp should be within the range of about 7 to about 11, preferably within the range of about 8 to about 9, prior to conditioning. In some cases, the pH of the ore pulp may fall within the desired range without the addition of any reagents, depending on the amount and type of specific ore being treated, the state of division of the ore, the amount and hardness of the water used, etc. By using a pH within these ranges, there is less tendency for certain of the gangue minerals to flocculate and become entrained in the concentrate during froth flotation or, conversely, for the mineral values to be lost in the tailings.

Most frequently, an upward adjustment of the pH of the pulp is required to fall within the desired range, in which case a water-soluble alkaline inorganic compound is thoroughly mixed with the pulp. Various water-soluble alkaline inorganic compounds conventionally used for pH regulation are acceptable, particularly the carbonates and hydroxides. Soda ash presently is the preferred alkaline inorganic compound; however, other compounds, such as sodium hydroxide, sodium silicate, sodium fluosilicate, sodium fluoborate, sodium phosphate, sodium borate, ammonium carbonate and the like, may be substituted in whole or in part for the soda ash. The amount of the alkaline inorganic compound used depends on, among other things, the variables mentioned above and the optimum quantity is best determined empirically. Generally, the amount used for most ores will be within the range of about 0.1 to about 5 pounds per ton of ore. As used herein, the term "ton" means short ton or 2,000 pounds avoirdupois.

The alkaline inorganic compound preferably is added to the pulp prior to the addition to the conditioning reagent. The alkaline inorganic compound is added to the pulp, either prior to or along with, its introduction into a ball mill for the final grinding. Optionally, the alkaline inorganic compound can be introduced into a rod mill along with water during initial grinding and pulp formation, in which case the alkaline inorganic compound is simultaneously mixed with the pulp during grinding.

In cases where the pH of the pulp has to be adjusted downwardly to fall within the desired range, an acid reagent, such as sulfuric acid, which does not introduce undesirable ions into the pulp can be used for this purpose.

The solids content of the pulp during conditioning is not particularly critical. It can be 50% or even higher depending on the particular ore or advantageously can be as low as 5%. When the pulp is to be diluted, the additional water can be added to the pulp either before or after its introduction into the conditioners.

The conditioning reagent is added to the pulp as an aqueous solution and is formed by incorporating a water-soluble polyvalent metal salt into an aqueous solution of a water-soluble alkali metal silicate. As used herein, the term "water-soluble polyvalent metal salt" encompasses metal salts containing a polyvalent metallic cation of Group I*b* or higher in the Periodic Table, *Handbook of Chemistry and Physics,* 56th Ed., CRC Press, Inc., (1975) and various water-soluble hydrated salts containing such cations.

Representative examples of suitable polyvalent metallic cations for the polyvalent metal salt include iron (ferrous and ferric), copper (cupric), aluminum, lead, chromium, manganese, cobalt, nickel, zinc, cadmium, magnesium, calcium, barium and mixtures thereof. Polyvalent metal salts containing iron (ferrous and ferric) as the cation are preferred, with those having ferric ion as the cation being the most preferred, because of their chemical stability and lower cost.

The water-soluble polyvalent metal salt can contain various anions including nitrates, sulfates, chlorides and acetates.

Representative examples of water-soluble polyvalent metal salts which are particularly suitable for use in the conditioning reagent include ferric nitrate, ferric chloride, ferrous nitrate, ferrous sulfate, cupric sulfate, cupric nitrate, aluminum sulfate, aluminum nitrate, aluminum chloride, lead nitrate, lead acetate, manganous sulfate, manganous chloride, zinc sulfate, zinc chloride and mixtures thereof.

The amount of polyvalent metal salts used is within the range of about 0.02 to about 2, preferably within the range of about 0.05 to about 1, pounds per ton of ore.

Suitable water-soluble alkali metal silicates include sodium silicate, potassium silicate, and mixtures thereof with sodium silicate being preferred. Particularly suitable are sodium silicates containing a weight ratio of $Na_2O$ to $SiO_2$ within the range of about 1:1 to about 1:3.75, preferably about 1:3.22.

The amount of alkali metal silicate used is within the range of about 0.05 to about 4, preferably within the range of about 0.1 to about 1, pounds per ton of ore in terms of the calculated $SiO_2$ equivalent. A commercially available solution of sodium silicate, containing about 9.15 weight % $Na_2O$, 29.5 weight % $SiO_2$ and about 62 weight % water and marketed by Philadelphia Quartz Co. as "O" Brand sodium silicate solution, is particularly suitable for use in preparing the conditioning reagent. The amount of this solution used is within the range of about 0.1 to about 14, preferably within the range of about 0.3 to about 4 pounds per ton of ore.

The conditioning reagent is prepared by forming a dilute aqueous solution of the water-soluble polyvalent metal salt and slowly adding this salt solution to an aqueous solution of the alkali metal silicate. In a preferred method for preparing the conditioning reagent, sufficient water is added to the above-mentioned commercially available "O" Brand sodium silicate solution to form a 5 weight % aqueous solution thereof, forming a dilute aqueous solution of the water-soluble polyvalent metal salt, e.g., a 2 weight % aqueous solution of ferric nitrate, $Fe(NO_3)_3 \cdot 9\ H_2O$, and slowly adding the salt solution to the diluted sodium silicate solution with stirring.

The polyvalent metal salt reacts with the sodium silicate and forms reaction products which are colloidally dispersed in the aqueous medium. Generally, the salt solution is added until the system becomes turbid without significant precipitation of the reaction products. Unless continuously agitated, the resultant colloidal dispersion becomes unstable within a relatively short time, e.g., within about 5 minutes. If the colloidal dispersion is added to the pulp within this time period and the pulp is at a pH at the lower end of the above-mentioned range, it can be used as a conditioning reagent without further treatment. However, such an operation ordinarily is not practical for commercial processes because it usually is more convenient to make up relatively large batches of the conditioning reagent for use as needed. Therefore, it is preferred to add a sufficient amount of an acid reagent, such as sulfuric acid, to the colloidal dispersion so as to solubilize the reaction products and form a system which is stable for extended time periods, preferably for periods up to several months. When the conditioning reagent is so stabilized, the desired amount of the active ingredients thereof can be accurately fed into the system as required.

When used, the amount of acid reagent added to the colloidal dispersion depends primarily upon the amount and particular type of polyvalent metal salt used. Generally, the acid reagent is slowly added to the colloidal dispersion until it changes from a turbid condition to a clear solution and the pH of the resultant solution is within the range of about 2 to about 5 depending upon the type of metal salt used. On the basis of the pulp, the amount of acid reagent used is 0 to about 2, preferably about 0.05 to about 1, pounds per ton of ore. The preferred weight ratio of the alkali metal silicate, in terms of the calculated $SiO_2$ equivalent, to the polyvalent metal salt and to the acid reagent is 2:1:1.

After the conditioning reagent has been added to the pulp, it is agitated for a sufficient time to insure uniform dispersion thereof throughout the pulp. Generally, an agitation time of about 1 to about 5 minutes will be sufficient for this purpose.

Following initial conditioning, the pH of the pulp preferably is finally adjusted to a value within the range of about 6 to about 10, most preferably within the range of about 8 to about 9. In some cases, the addition of the conditioning reagent may alone be sufficient to adjust the pH to the desired value, depending primarily on the amount and type of ore being processed, the amount and hardness of the water being used and whether or not the conditioning reagent contains an acid reagent. In other cases, it may be necessary to make a final adjustment of the pH, either upwardly or downwardly, in order to obtain an optimum value when required, such a final pH adjustment most preferably is made just prior to the addition of the collector.

When a downward adjustment of the pH is required, any acid reagent which does not introduce undesirable ions into the pulp is added to and thoroughly mixed with the pulp. Generally, sulfuric acid is preferred because of its low cost and availability. In those cases where an alkaline agent is required to adjust the pH upwardly, similar conditions apply. Generally, any of the above-described water-soluble, alkaline inorganic compounds can be used for this purpose.

Following initial conditioning of the pulp, and preferably after final pH adjustment (when required), an anionic collector is added to and thoroughly mixed with the pulp. While less desirable, the agent required for making the final adjustment of the pH of the pulp can be added to the pulp after addition of the collector so long as the pulp is subsequently agitated.

Various conventional anionic collectors known to be selective for flotation of spodumene and other lithium values can be used. Suitable anionic collectors are the higher and intermediate, saturated and unsaturated fatty acids and water-soluble soaps thereof containing at least about 8 and up to about 20, preferably between 10 and 18, carbon atoms in their primary chains.

Representative examples of suitable anionic collectors include oleic acid, linoleic acid, linolenic acid, stearic acid, palmitic acid, rosin acid, fish oil fatty acid, water-soluble soaps derived from these acids, and mixtures of such acids and/or soaps. Fatty acids of low rosin content generally are the preferred collectors because of their lower cost and availability. Examples of particularly suitable commercially available anionic collectors include PAMAK-4, which is a refined fatty acid collector comprised primarily of oleic and linoleic acids and marketed by Hercules, and FA-2 and L-4 which are similar products marketed by Arizona Chemical and West Virginia Chemical, respectively.

Generally, the amount of collector used is within the range of about 0.1 to about 3, preferably within the range of about 0.5 to about 2 pounds per ton of ore.

After the collector has been added, the pulp is agitated for a sufficient time to insure uniform dispersion of the collector throughout the pulp. Generally, an agitation time of about 5 to about 20 minutes will be sufficient for this purpose.

As alluded to above, one of the advantages of the invention is that the solids content of the pulp during conditioning can be substantially lower than for conventional flotation processes employing fatty acid collectors. Such conventional processes typically require a solids content of 50% or more during conditioning and, consequently, intense agitation of the pulp usually is required. Also, the pulp usually must be concentrated after classification, either in a separate thickening step or concurrently with a desliming step. In either case, lithium values are lost in the overflow or tailings.

In accordance with one aspect of the invention, conditioning can be carried out at a solids content within the range of about 5 to about 30%, thereby eliminating the necessity for concentrating the pulp after classification and decreasing the energy required for agitation. On the other hand, the solids content can be at a higher level, e.g., 50% or higher, typically used in conventional processes.

Following final conditioning, the conditioned pulp is processed in a conventional flotation circuit which typically includes a rougher flotation stage wherein the spodumene floats and is separated as a concentrate in the froth and gangue materials report in the tailings. The froth and tailing from the rougher flotation stage may be subjected to a plurality of conventional cleaning and/or scavenging steps to improve the grade of the lithium concentrate and to maximize recovery of lithium oxide.

Fatty acid, anionic collectors normally provide adequate frothing during re-float cleaning steps. In some cases it may be necessary to add a small amount of fuel oil or a conventional frothing agent, such as the higher alcohols (e.g., methyl isobutyl carbinol), pine oil, cresylic acid, and the like. The amount of frothing agent used depends primarily upon the number of cleaning steps involved, with larger amounts being used as the number of cleaning steps is increased. When used, the frothing agent can be incorporated into the pulp before, after, or together with the collector and, generally, in amounts up to about 0.5 pounds per ton of ore. If the frothing agent is added separately, the pulp is agitated for a sufficient time to insure uniform dispersion of the frothing agent throughout the pulp. Generally, an agitation time of up to 2 minutes will be sufficient for this purpose.

While the solids content of the pulp for flotation can vary over a wide range, it preferably is within the range of about 5 to about 35%. Depending on the solids content of the pulp during conditioning, it may be necessary to dilute the pulp with water to obtain the desired value for flotation.

While the process is particularly effective for beneficiating spodumene-containing ores, it can also be used to treat ores of other lithium containing minerals, such as lepidolite, $KLi[Al(OH, F)_2]\ Al(SiO_3)_3$, petalite, $LiO_2.Al_2O_3.8SiO_2$, and amblygonite, $AlPO_4.LiF$. All of these minerals occur in significant quantity in various pegmatites. Also, it can be used to recover spodumene from slime fractions discarded from conventional flotation processes. The process generally can be operated at atmospheric pressures and temperatures, thereby minimizing the necessity for special operating conditions or special equipment.

Among the several particular advantages of the process of the invention, probably the most important is the fact a high recovery of $Li_2O$ can be obtained from low grade, spodumene-containing ores, i.e., pegmatites containing about 5 to about 25% spodumene, even though relatively small amounts of inexpensive reagents are employed. Further, the $Li_2O$ content in the recovered spodumene concentrate is high enough for the concentrate to be used in various commercial applications, including the ceramic industry. For the latter application, it may be necessary to subject the concentrate to a magnetic separation step to reduce the iron oxide concentration.

The following specific examples are presented to illustrate the invention and are not to be construed as limitations thereof.

EXAMPLE 1

A conditioning reagent in accordance with the invention was prepared by slowly adding, with stirring, 1.5 ml of a 2% solution of ferric nitrate, $Fe(NO_3)_3.9\ H_2O$ to 3 ml of a 5% solution of "O" Brand sodium silicate solution described above and then stirring the resultant reaction medium for 1 minute to form a turbid colloidal dispersion. 0.25 ml of 15% sulfuric acid was then slowly added with stirring to the dispersion at 25° C to form a clear solution. The pH of the resultant solution was 2.4 and the weight ratios of the "O" Brand sodium silicate solution (as purchased) to the ferric nitrate and to sulfuric acid were 5:1:1.

600 g of −10 mesh spodumene-containing pegmatite ore obtained from a mine in the Kings Mountain district of North Carolina, (felspar, quartz and muscovite the major gangue minerals) were wet ground for 15 minutes in a stainless steel rod mill with an amount of soda ash equivalent to 2.5 lb./ton of ore and with a sufficient amount of deionized water to produce a slurry containing about 55% solids.

The ground charge, about 60% passing a 200 mesh screen, was transferred to a container and diluted with sufficient additional water to give a pulp containing about 25 weight % solids. 4.75 ml of the previously prepared conditioning reagent (equivalent to 0.5 lb. sodium silicate/ton of ore, 0.1 lb. ferric nitrate/ton of ore, and 0.1 lb. sulfuric acid/ton of ore) was added to the pulp and the pulp was subsequently conditioned for 2 minutes in a laboratory Fagergren machine operated at 1250 RPM, during which time the pH of the pulp was adjusted to about 8.2 by adding sulfuric acid. An amount of PAMAK-4 equivalent to 0.75 lb./ton of ore was then added and the pulp, at a solids content of about 23% was conditioned for 1 more minute. An amount of No. 2 fuel oil equivalent to 0.1 lb./ton of ore was then added and the pulp was conditioned for another 7 minutes.

The conditioned pulp was transferred to a laboratory Fagergren flotation machine, followed by rougher flotation for 8 minutes at 1250 RPM. The rougher concentrate (froth product) was cleaned by successively refloating 3 times in flotation cells using deionized water for dilution and without additional conditioning or frothing agents. The final concentrate and tailing was filtered, dried, weighed and analyzed for lithium content. The metallurgical results from this test are summarized in Table I.

Table I

| Product | Weight % | % $Li_2O$ | % $Li_2O$ Distribution |
|---|---|---|---|
| Head | 100.0 | 2.35 | 100.0 |
| Concentrate | 31.6 | 6.15 | 82.7 |
| Tailings | 68.4 | 0.59 | 17.3 |

EXAMPLE 2

To demonstrate the applicability of the process of the invention to slimy ores, a test was performed on a slime waste from a commercial spodumene ore flotation process employing a conventional desliming step. The slimes were conditioned as received in a manner similar to that described in Example 1, using the same chemical reagents at approximately the same concentrations, except a 100 g charge was used and the flotation was conducted in a 250 gram Denver cell. The metallurgical results from this test are summarized in Table II.

Table II

| Product | Weight % | % $Li_2O$ | % $Li_2O$ Distribution |
|---|---|---|---|
| Slime head | 100.0 | 1.44 | 100.0 |
| Concentrate | 11.2 | 3.50 | 27.2 |
| Tailings | 88.8 | 1.18 | 72.8 |

While the recovery of $Li_2O$ from the slimes was considerably less than that attained with crude ore, this recovery is substantially higher than is typically obtainable with commercial flotation processes. The flotation process from which the slimes were obtained employed flocculating chemicals to accelerate settling of suspended solids. The lower $Li_2O$ recovery from the slimes probably is due to modifications of the surface characteristics caused by these flocculating chemicals.

From the foregoing description, one skilled in the art can easily ascertain the essential characteristics of this invention, and without departing from the spirit and scope thereof, can make various modifications and changes to adapt the invention to various usages and conditions.

I claim:

1. A method of beneficiating lithium-containing ores by froth flotation of lithium values from gangue including the steps of forming an aqueous pulp of the ore having a particle size suitable for froth flotation;

conditioning the pulp by adding thereto a pre-mixed conditioning reagent, formed by mixing a water-soluble polyvalent metal salt with an aqueous solution of an alkali metal silicate, in an amount sufficient to provide from about 0.05 to about 4 pounds of alkali metal silicate per ton of ore, calculated as $SiO_2$ equivalent, and from about 0.02 to about 2 pounds of polyvalent metal salt per ton of ore and by adding thereto an effective amount of an anionic collector selective to flotation of lithium values; and subjecting the conditioned pulp to a flotation operation whereby a concentrate containing a major portion of lithium value and a tailing relatively rich in gangue are produced.

2. A method according to claim 1 wherein said alkali metal silicate is sodium silicate having a $Na_2O$ to $SiO_2$ weight ratio within the range from 1:1 to 1:3.75.

3. A method according to claim 1 wherein said conditioning reagent further includes an inorganic acid in an amount sufficient to provide up to about 2 pounds of the acid per ton of ore.

4. A method according to claim 1 wherein said polyvalent metal salt contains a cation selected from the group consisting of iron (ferric and ferrous), copper (cupric), aluminum, lead, chromium, manganese, cobalt, nickel, zinc, cadmium, magnesium, calcium, barium and mixtures thereof.

5. A method according to claim 2 wherein said sodium silicate has a $Na_2O$ to $SiO_2$ weight ratio of about 1:3.22 and said polyvalent metal salt is ferric nitrate.

6. A method according to claim 1 wherein said anionic collector is selected from the group consisting of a saturated and unsaturated fatty acids containing about 8 to about 20 carbon atoms, water-soluble soaps derived from said fatty acids, and mixtures thereof.

7. A method according to claim 1 including the step of adding up to about 0.5 pounds of a frothing agent per ton of ore to the conditioned pulp prior to the flotation operation.

8. A method according to claim 1 including adding to the pulp prior to conditioning a sufficient amount of a water-soluble alkaline inorganic compound to adjust the pH of the pulp within the range of about 7 to about 11.

9. A method according to claim 8 wherein said alkaline inorganic compound is selected from the group consisting of sodium hydroxide, sodium carbonate, sodium silicate and mixtures thereof.

10. A method according to claim 1 wherein the pH of the conditioned pulp is within the range of about 6 to about 10 prior to the addition of said collector.

11. A method according to claim 1 wherein the solids content of the pulp is within the range of about 5 to about 30% during said conditioning step.

12. A method according to claim 1 wherein the lithium-containing ore beneficiated is a pegmatite containing about 5 to about 25% spodumene.

13. A method according to claim 1 wherein the ore in the pulp is a slimy ore.

* * * * *